United States Patent [19]

Matthews

[11] 4,327,532

[45] May 4, 1982

[54] ADJUSTABLE ANGLE EAVE APPARATUS

[75] Inventor: Thomas E. Matthews, Niles, Mich.

[73] Assignee: Kawneer Company, Inc., Niles, Mich.

[21] Appl. No.: 170,031

[22] Filed: Jul. 18, 1980

[51] Int. Cl.[3] ..... E04B 7/02

[52] U.S. Cl. ..... 52/92; 52/200

[58] Field of Search ..... 52/90–97, 52/86, 72, 200

[56] References Cited

U.S. PATENT DOCUMENTS

| | | | |
|---|---|---|---|
| 913,217 | 2/1909 | Kurowski | 52/90 |
| 1,387,698 | 8/1921 | Erickson | 52/92 |
| 1,787,167 | 12/1930 | Purdy | 52/92 |
| 1,931,750 | 10/1933 | Blaski | 52/90 X |
| 2,234,960 | 3/1941 | Buelow | 52/92 X |
| 2,936,862 | 5/1960 | Cvikl | 52/90 X |
| 3,296,752 | 1/1967 | Philp | 52/90 X |
| 3,488,899 | 1/1970 | Schultz et al. | 52/95 X |
| 3,749,428 | 7/1973 | Hustead | 52/90 X |
| 3,771,277 | 11/1973 | Rausch et al. | 52/90 X |
| 3,866,381 | 2/1975 | Eschbach et al. | 52/94 X |
| 3,874,131 | 4/1975 | Webster | 52/95 X |
| 3,971,185 | 7/1976 | Hendrich | 52/90 X |
| 4,000,588 | 1/1977 | van der Lely | 52/90 X |
| 4,070,806 | 1/1978 | Hubbard | 52/97 X |
| 4,078,341 | 3/1978 | Peterson et al. | 52/90 X |
| 4,114,330 | 9/1978 | Sukolics | 52/200 |

*Primary Examiner*—J. Karl Bell

*Attorney, Agent, or Firm*—Mason, Kolehmainen, Rathburn & Wyss

[57] ABSTRACT

An adjustable angle eave apparatus for building curtain walls, skylights, greenhouses and the like, comprises an elongated sill forming a gutter for receiving moisture from a sloping roof structure projecting upwardly thereof. The roof structure includes one or more sloping rafters and an elongated baffle member secured to the lower ends of the rafters and extending along the sill forming a framework for supporting one or more roof or skylight panels. A bearing system is provided for pivotally interconnecting the sill and the baffle members permitting angular adjustment of the slope angle of the roof structure and an elongated sill cover is provided for enclosing the space between an outer edge portion of the sill member and an upper edge portion of the baffle member of the roof structure to provide a weather sealed enclosure at the eave.

21 Claims, 4 Drawing Figures

FIG. 3
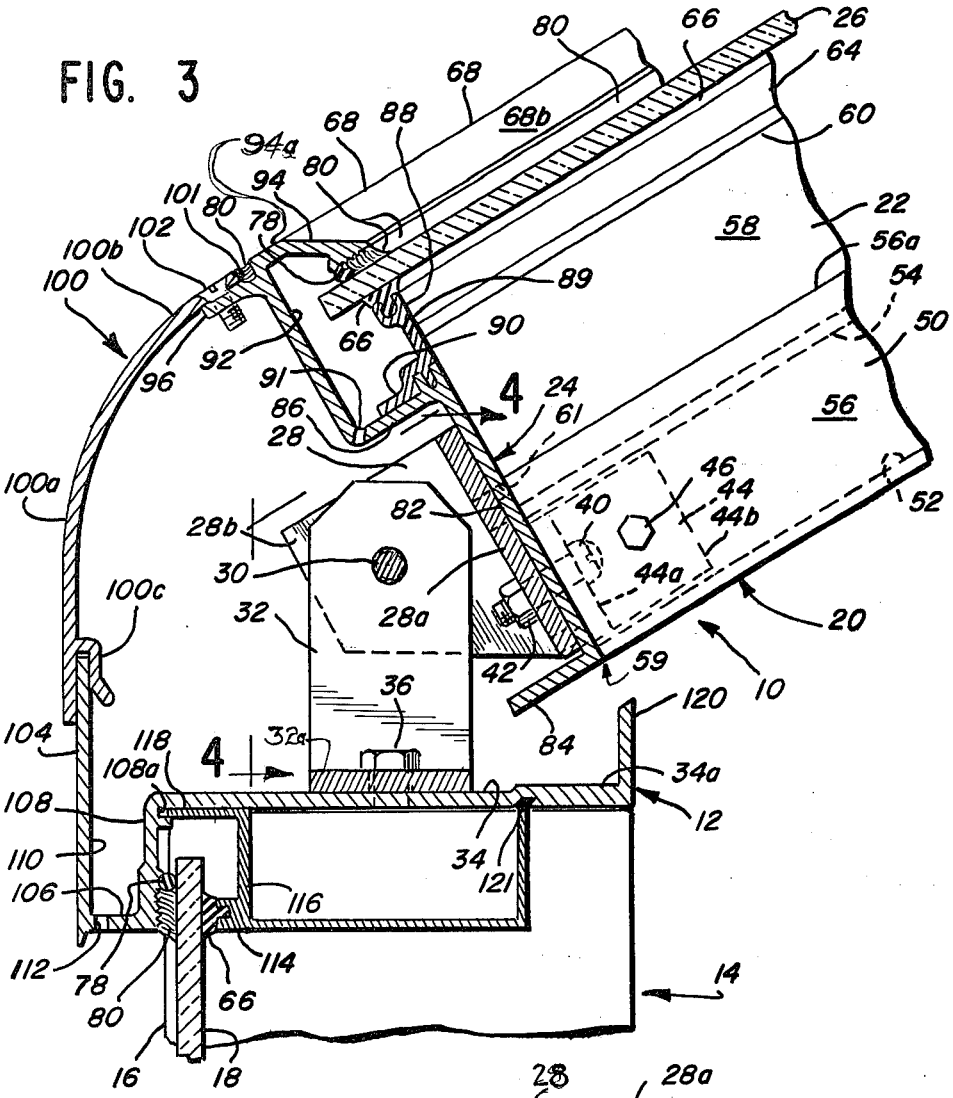
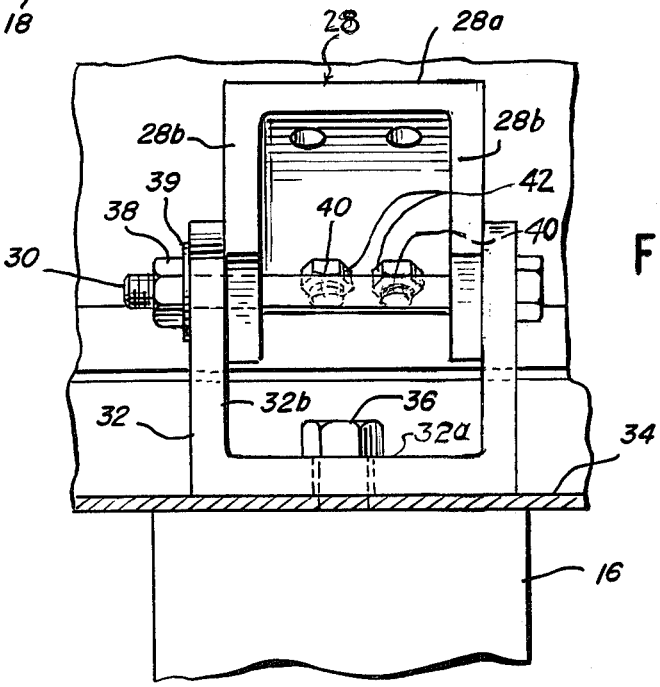
FIG. 4

ADJUSTABLE ANGLE EAVE APPARATUS

BACKGROUND OF THE INVENTION

1. Field of the Invention

The present invention relates to an adjustable angle eave apparatus and more particularly to an adjustable angle eave apparagus for use in sloping curtain wall structures, skylights, greenhouses and the like wherein a sloping roof structure is pivotally interconnected along an eave with a sill or plate mounted on a wall or base structure of a building.

2. Brief Description of the Prior Art

Over the years, a wide variety of systems have been developed providing for adjustable angles of slope between a skylight or roof structure and a supporting wall. Typical such prior art structures are shown in U.S. Pat. Nos. 913,217; 1,387,798; 1,787,167; 2,234,960; 3,296,752; 3,771,277; 3,971,185; 4,000,588 and 4,078,341. In addition, a sloped curtain wall structure is shown in U.S. Pat. No. 4,070,806 and a modular skylight system is provided in U.S. Pat. No. 4,114,330, both of which patents are assigned to the same assignee as the present application.

OBJECTS OF THE PRESENT INVENTION

It is an object of the present invention to provide a new and improved, adjustable angle eave assembly which diminishes or eliminates many of the difficulties encountered with prior art systems.

Still another object of the present invention is to provide a new and improved, adjustable angle eave apparatus which provides a wide range of slope angles for a roof or skylight structure that slopes upwardly of a plate or a sill on a building wall structure or base.

Still another object of the present invention is to provide a new and improved, adjustable angle eave assembly wherein installation in the field is greatly facilitated even though the actual angle of slope of the roof structure may be different from the angle originally intended and provided in the building design.

Yet another object of the present invention is to provide a new and improved, adjustable angle eave assembly which does not require the cutting of rafters and other structural members with compound or acute angle end cuts and which for the most part, utilizes only square cut ends on elongated structural framing members.

Still another object of the present invention is to provide a new and improved, adjustable angle eave assembly which facilitates a reduction in design, layout, and engineering time that is normally required and yet can be rapidly and easily installed and erected at a job site by workmen having only ordinary skill levels.

Yet another object of the present invention is to provide a new and improved, adjustable angle ease assembly having an elongated sill adapted to serve as a gutter for receiving condensation or leakage moisture from the inside of a roof structure.

Still another object of the present invention is to provide a new and improved, adjustable angle eave assembly wherein roof or curtain wall structural rafters may be square cut at the ends for attachment to an elongated baffle element, which element is mounted for angular adjustment with respect to a sill member along the eave of the building wall structure.

Another object of the present invention is to provide a new and improved, adjustable angle eave assembly having novel means for supporting a lower edge portion of a sloping curtain wall or roof structure which slopes upwardly of an elongated sill or gutter element mounted along an upper edge of a vertical wall component.

SUMMARY OF THE INVENTION

The foregoing and other objects and advantages of the present invention are accomplished in a new and improved, adjustable angle eave apparatus which includes an elongated sill member forming a gutter for receiving moisture collected from a sloping roof or curtain wall structure which extends on a slope upwardly of the sill. The roof structure includes one or more sloping rafters and an elongated baffle member secured to the lower ends of the rafters to extend along the sill member. The baffle and rafters support one or more roof or skylight panels of the roof structure. Bearing means is provided for pivotally and structurally interconnecting the sill and baffle members to permit a range of angular adjustment of the slope of the roof structure yet without requiring acute angular end cuts or compound angle cuts on the rafters or other elongated structural members. An elongated, sill cover is installed to enclose and cover the space between an outer edge portion of the sill member and an upper edge portion of the baffle member of the roof structure and the sill cover is field cut or trimmed along one edge ot a desired width dependent upon the actual angle of slope required. After cutting, the trimmed edge of the cover is sealingly secured to the baffle along the length thereof to provide a weather tight enclosure along the eave.

BRIEF DESCRIPTION OF THE DRAWINGS

For a better understanding of the present invention, reference should be had to the following detailed description taken in conjunction with the drawings, in which:

FIG. 3 is a vertical cross-sectional view similar to FIG. 1, but illustrating the adjustable angle eave apparatus with the roof structure having a different slope angle; and FIG. 4 is a fragmentary sectional view looking in the direction of arrows 4—4 of FIG. 3.

DESCRIPTION OF THE PREFERRED EMBODIMENT

Figure 1:
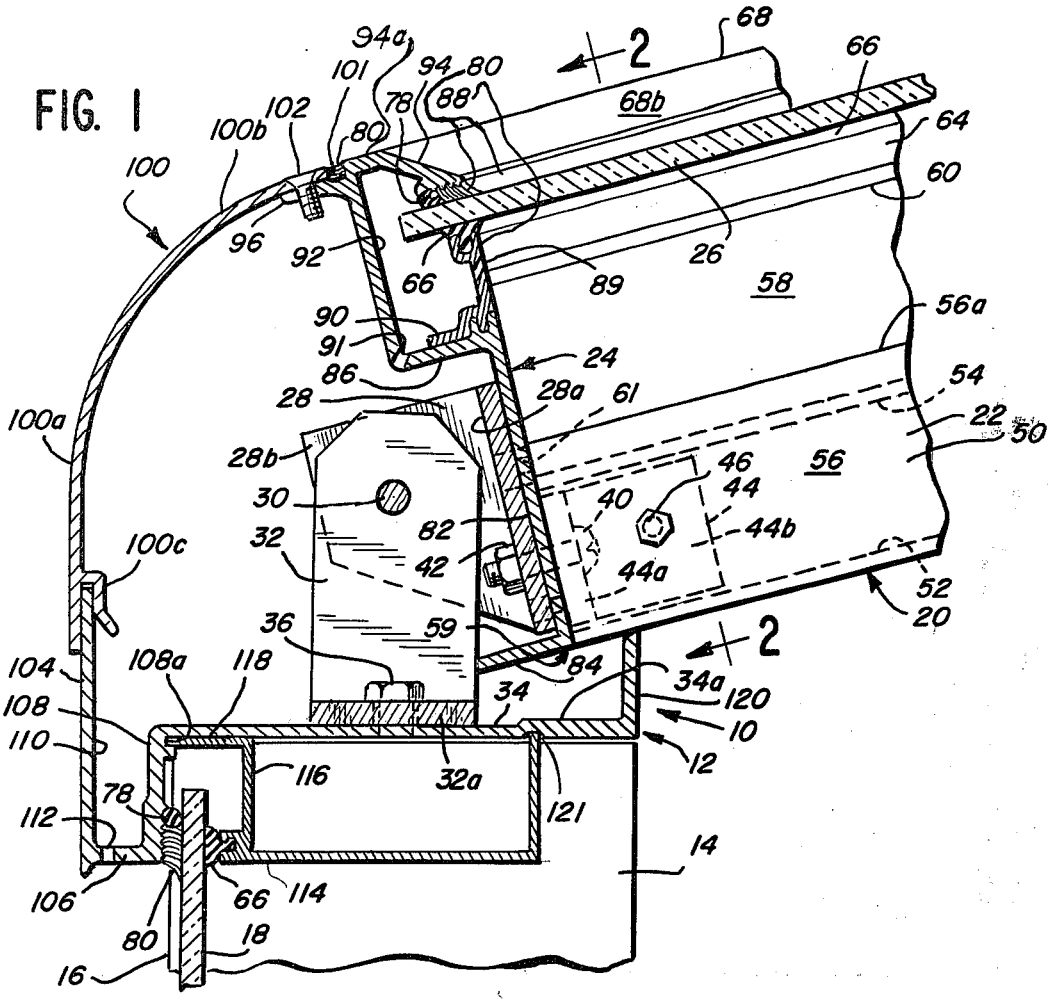
FIG. 1 is a vertical cross-sectional view illustrating a new and improved adjustable angle eave appartus constructed in accordance with the features of the present invention.

Referring now more particularly to the drawings, therein is illustrated a new and improved, adjustable angle eave apparatus constructed in accordance with the features of the present invention and referred to generally by the reference numeral 10.

The adjustable angle eave apparatus includes an elongated sill element of generally channel-shaped transverse cross-section, preferably formed of extruded aluminum and referred to generally by the reference numeral 12. The sill or plate element is adapted to be mounted along an upper edge of an upstanding wall or base structure 14 which may include a plurality of vertical mullions or posts 16 forming a framework for supporting relatively large rectangular panels such as glazing panels 18 mounted adjacent an outer edge of the wall structure.

In accordance with the invention, the adjustable angle eave apparatus 10 is adapted to provide a weather tight enclosure between the vertical wall structure 14 and an upwardly sloping roof, curtain wall or skylight structure generally indicated by the reference numeral 20. The roof structure includes a supporting framework comprising a plurality of upwardly sloping, elongated rafters 22 which are square cut at the lower ends and are interconnected at the lower end to an elongated baffle member 24 generally parallel of and spaced above the elongated sill member 12 as best shown in FIGS. 1 and 3.

Figure 2:
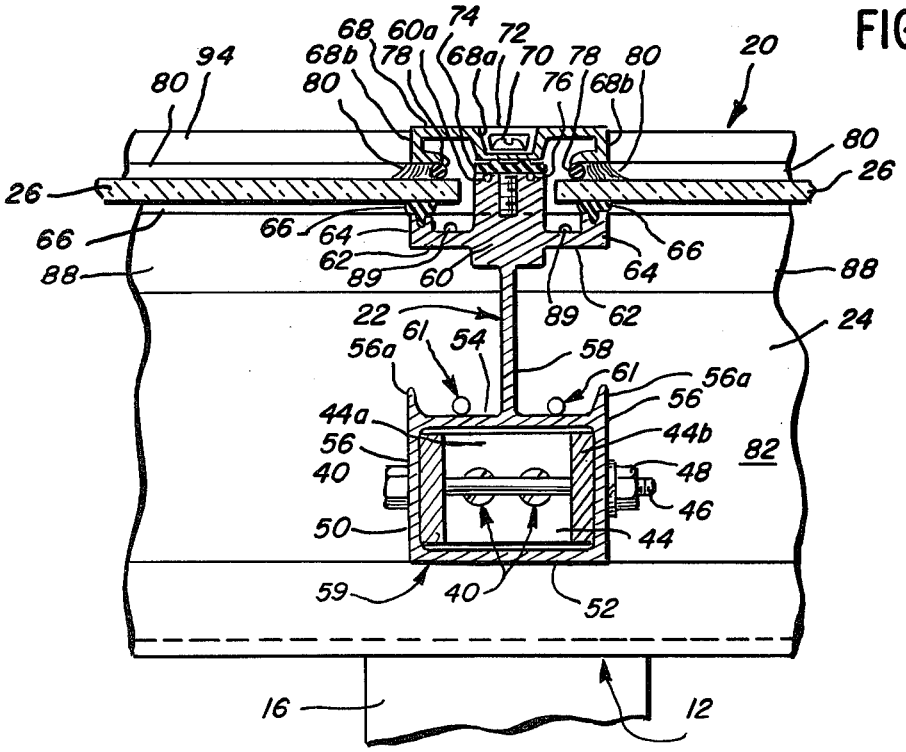
FIG. 2 is a fragmentary, cross-sectional view taken substantially along lines 2—2 of FIG. 1.

The rafters 22 and baffle member 24 provide structural support for one or more relatively large, rectangular-shaped, roof or glazing panels 26 and a lower marginal edge portion of the glazing panels is supported from the baffle member 24 whereas marginal edge portions along opposite side edges of the panels are supported by the sloping rafters 22 as shown in FIG. 2.

Preferably, the sloping rafters and the baffle member of the roof structure 20 are formed of extruded aluminum and may be cut to appropriate lengths either at a job site in the field or at a fabrication plant because almost all of the cuts required on these members are square cut or transverse end cuts as shown in FIGS. 1 and 3 and the number of more sophisticated, acute angular cuts or compound angular cuts that are required is minimized or eliminated.

Referring now to FIGS. 1 and 3, it will be seen that the upward slope angle of the roof structure 20 is somewhat greater in the latter figure and the slope angle may vary through a relatively wide angular range or be of only a minor angular variation due to inaccuracies encountered during erection of the structure such as imperfect leveling of a sill and/or dimensional inaccuracies in the sill or other structural members. In any event, the adjustable angle eave apparatus 10 of the present invention is especially adapted to take into account any variations in the angular slope of the roof structure 20 and for this purpose includes a thrust bearing mechanism comprising one or more channel brackets 28 secured to the elongated baffle member 24 at appropriate spacing intervals along the length thereof. The brackets are supported on pivot bolts 30 and in turn, the pivot bolts are supported on channel brackets 32 mounted on the sill member 12 at appropriate spacing intervals aligned with the rafters.

The lower channel bracket 32 includes a horizontal, bottom web **32*a* and a pair of upstanding vertical legs 32*b* having a drilled aperture for accommodating a pivot bolt 30 extended through the aperture. The lower web 32*a* of the bracket is adapted to rest on an upper surface of a bottom wall portion 34 of the elongated sill member and is secured to the wall structure 14 by anchor bolt or cap screw 36 having a shank portion extending downwardly through an aperture provided in the web 32*a* and an aligned hole in the sill bottom wall 34** into the vertical wall structure or base.

The upper bracket 28 includes a web **28*a* abutting an outside face of a lower portion of the elongated baffle member 24 and outwardly extending legs 28*b* having an opening therein for receiving the pivot bolt 30 to provide a pivotal interconnection between the bracket legs 32*b* and 28*b* and thus provide for angular adjustment between the vertical wall structure and the roof structure 20. A lock nut 38 and washer 39 is provided for each pivot bolt 30 to secure the brackets 28 and 32** together.

In accordance with the invention, the web **28*a* of the upper bracket 28 is secured to the baffle element 24 by a bolt 40 and nut 42 with the shank of the bolt extending through a pair of aligned, drilled openings or holes in the bracket leg and the baffle element, respectively. In addition, an internal bracket 44 having a web 44*a* is provided on the interior of a lower portion of each elongated rafter 22 at the lower end and the shank of each mounting bolt 40 projects through an opening in the bracket web 44*a* aligned with the drilled openings or apertures in the bracket web 28*a* and the baffle element 24. A right angle leg 44*b* of the bracket 44 is bolted to a sidewall of the lower portion of the rafter 22 by a bolt 46 and nut 48 and thus the bracket 44 provides a positive interconnection between the squared-off lower ends of the rafters 22 and the elongated baffle element 24. The spacing interval between the rafters 22 is determined by the structural requirements and load design factor of the roof structure 20**.

The rafters 22 of the roof structure may be of the type shown and described in the aforementioned U.S. Pat. No. 4,070,806 and these rafters include a hollow, tubular, lower flange section 50 having a generally rectangular transverse cross-section with a bottom wall 52, an upper wall 54 and a pair of opposite sidewalls 56 having upper portions **56*a* extending above the level of the upper wall 54 to form drainage gutters. The gutters are formed on opposite sides of an upwardly extending, integral web portion 58. The lower, hollow, tubular flange section 50 provides a lower gutter for the roof structure 20 and any moisture accumulated therein is passed out onto the bottom wall 54 of the sill member 12 through the joint at 59 where rafter butts to baffle member 24**.

Any moisture or water collected on the next upper, trough-like gutters formed by the side wall sections **56*a* on opposite sides of the web 58 is transferred onto the bottom wall 34 of the sill member 12 through pairs of drilled weep holes or drain openings 61 in the baffle 34**.

Along an upper edge of the web 58, the rafter 22 is formed with an integral, relatively thick, upper edge flange 60 having a generally rectangular transverse cross-section as shown in FIG. 2, and the upper flange is formed with a pair of laterally outwardly extending, panel supporting ribs 62, each having a thickened outer end portion 64 with a groove in the upper edge for keyed interconnection with an elongated glazing wedge 66 formed of resilient plastic material. The glazing wedges provide support for the underside of the marginal side edge portions of the glazing panels 26 which rest thereon.

After the glazing or roof panels 26 are installed on the rafters, an elongated rafter cap member 68 is secured on top of the upper flange portion 60 with a plurality of cap screws 70 at appropriate intervals along the length of the rafter. The heads of the cap screws are recessed within an elongated groove formed to extend along the center line of the rafter cap 68 and after the screws are installed, a removable, channel-shaped weather strip 72 is seated in the groove to cover the cap screw heads. Threaded shanks of the cap screws extend downwardly into threaded bores provided at appropriate intervals along the length of the rafter and an insulating sealing strip or block 74 is provided between a lower surface portion of the central portion of the rafter cap 68 and an upper surface of the top flange portion 60 of the rafters as shown. Additionally, an upper surface on the upper flange portion 60 of the rafters may be provided with circular grooves 60*a* to retain the insulating seal strip 74 as shown in FIG. 2

Along opposite side edges, the rafter cap 68 is formed with downwardly extending L-shaped flanges 68*b* and the underside of these flanges are engaged by elongated sealing strips 78 to provide a weather seal between the bottom surface of the flanges and an upper surface of the glazing panels 26 along a marginal side edge portion thereof. A final weather seal is provided by gunned-in-place caulking material 80 to form a moisture tight closure for the roof panels around the edges supported by the rafter 22 and baffle element 24.

In accordance with the invention, the baffle element 24 includes a lower, channel-shaped portion having a web 82 abutting the square-cut ends of the rafters 22 at the lower tubular section 50 and a portion of the web 58. Along the lower edge of the web 82, a bottom flange 84 is integrally formed to extend transversely of the web and along an upper edge, an upper transverse flange 86 is provided to form the bottom wall of an upper gutter structure for the baffle element 24 as shown in FIGS. 1 and 3.

In order to support a lower marginal edge portion of a single-thickness, glazing panel 26, the baffle member 24 is provided with a removable angular shaped, stop element or spacer 88 having a grooved upper edge portion formed in a thickened rib structure for accommodating the key rib of a glazing wedge 66 for supporting the underside of the glazing panels. The spacer element 88 includes a transverse, outwardly extending, integral, lower flange portion 90 which rests on an upper surface of the flange 86 of the baffle element 24 and is keyed to interlock therewith with a tongue and groove coupling as shown in FIGS. 1 and 3. When thicker roof panels such as insulating glass or the like are utilized, the stop or spacer element 88 is not used and the glazing wedge 66 is installed in the groove rib of the baffle element above the flange 86. The spacer element 88 is provided with pairs of weep holes 89 positioned on opposite sides of the upper flange segment 60 of each rafter 22 in order to drain any moisture that may collect in the upper gutters of the rafters. This water or moisture is passed onto the baffle element 24 and is drained downwardly through weep holes 91 provided at appropriate intervals along the length of the flange 86.

The upper gutter of the baffle element 24 is completed by an integral upstanding gutter wall 92 parallel of the web 82 and the wall 92 faces the lower edge of the glazing panels 26 and projects upwardly thereof. Along the upper edge, the gutter wall 92 is formed with an integral cap portion 94 which extends toward the adjacent edge of the glazing panels and slopes downwardly toward the upper surface of the panel so that a lower edge surface of the cap portion may be sealed with the panels by an elongated sealing strip 78 and gunned-in-place caulking material 80 to provide a weather tight seal.

The gutter wall 92 also includes an outwardly and downwardly extending integral flange 96 having an upper surface spaced below the upper surface of the cap portion 94 so that a field trimmed, free upper edge portion of an arcuately curved, cover member 100 can be installed with an upper face of the cover even with the uppermost surface of the cap portion 94 of the baffle element 24.

In accordance with the present invention, the cover element 100 is formed from an elongated extrusion having a planar lower segment 100*a* and an arcuately curved upper segment 100*b* with an outer surface formed generally of a cylindrical shape about an axis of generation coincident with the axis of the pivot pins 30. Accordingly, as the angle of slope of the roof structure 20 is changed or varied as shown in FIGS. 1 and 3, and upper surface of the curved portion 100*b* of the cover element is maintained even with an upper surface 94*a* of the cap portion 94 on the baffle element 24.

In the original extruded form, the cover element 100 includes an arcuate upper segment 100*b* having at a full 90° curvature and when the cover element is installed in the field, an upper edge 101 is cut or trimmed at the installation site to precisely the correct dimension for overlapping the upper surface of the flange 96 on the baffle element 24. As illustrated, the edge 101 is trimmed to provide a short space between the outer surface on the upper edge of the gutter wall 92 and a strip of gunned-in-place caulking material 80 is utilized for effecting a weather tight seal between the cover and baffle. In addition, along the trimmed upper edge portion, the cover element 100 is securely fastened to the flange 96 of the baffle element 24 at appropriate intervals by counter sink head screw fasteners 102.

The cover element 100 includes a Z-shaped flange 100*c* on the inside surface of the lower planar segment 100*a* and this flange provides a weather tight sealed interlock with an upper edge portion of an upstanding outside edge wall 104 of the elongated sill member 12. The outside wall is integrally connected with a narrow, inwardly extending, horizontal bottom wall 106 and an inner upstanding wall 108 parallel of the outside wall, is integrally connected with the bottom wall. The wall 108 is integrally connected along an upper edge ith the main bottom wall 34 of the sill. The walls 104, 106 and 108 form an outer gutter or trough 110 for collected moisture and the collected moisture is discharged outside of the building wall structure 14 through a plurality of weep holes 112 in the bottom wall 106.

An inwardly facing lower portion of the inside gutter wall 108 is provided with ridges and grooves in order to accommodate an elongated flexible plastic sealing strip 78 and a strip of gunned-in-place caulking material 80 which provides a weather tight seal against the outside face of the vertical wall glazing panels 18 of the wall structure 14. On the inside face of the glazing panels, a glazing wedge 66 is provided and is keyed in a groove of a lower rib 114 on a channel-shaped, glass stop 116. The glass stop has a horizontal upper flange structure 118 with an outer edge forming a tongue which is received in a groove 108*a* provided at the upper edge of the inside gutter wall 108. A groove 121 is formed on the underside of the bottom wall portion 34*a* to retain the angular leg of the channel-shaped stop 116.

Along an inside edge, the bottom wall 34 of the sill or plate is provided with an integral upstanding, inside gutter wall 120 parallel of the outside wall 104. The wall 120 prevents moisture that is collected on the bottom wall 34 of the sill member 12 from flowing or spilling over into the interior of the building. Adjacent the inside edge, the bottom wall 34 is provided with a thickened portion 34*a* to further facilitate an outward flow of the collected moisture and to provide additional structural stiffness for the sill member.

It will thus be seen that the adjustable angle eave assembly 10 in accordance with the present invention provides an angularly adjustable, weather tight enclosure along the eave of a building structure at the junction between an upper edge of a vertical wall structure 14 and a lower edge portion of an upwardly sloping roof structure 20. The dead loads and live loads imposed on and by the roof structure 20 are transmitted from the elongated baffle element 24 through the brackets 28 and 32 and the pivot bolts 30 onto the lower vertical wall structure or base 14 through the anchor bolts 36. The system includes provision for collection and drainage of any moisture collected on the rafters or baffle member of the roof structure and provides means for discharging this collected moisture outwardly of the sill or gutter structure 12 to the outside atmosphere through the weep holes 112.

In installation of the adjustable angle eave assembly 10 of the present invention, the sill member 12 is mounted along an upper edge of the wall structure 14 and the lower pivot brackets 32 are anchored in place with the anchor bolts 36. The roof structure 20 is then pivotally interconnected to the wall structure along the lower edge baffle 24 with the brackets 28 and the pivot bolts 30. The angular slope of the roof structure 20 may be varied or adjusted as needed and after the angle is set, the elongated cover member 100 is field trimmed to fit along the upper edge 101 to seal and enclose the space along the eave between an upper edge of the baffle element 24 and the outside gutter wall 104 of the sill member 12. After trimming to fit, the upper edge portion on the curved wall segment **100*b* of the cover is seated in place on the flange 96 of the baffle member and is secured with screw fasteners 102 at appropriate intervals and gunned-in-place caulking 80 is applied to finally seal between the trimmed edge 101 and the adjacent outer edge surface on the wall 92** of the baffle member.

From the foregoing it will be seen that the adjustable angle eave assembly 10 in accordance with the present invention is especially well adapted to accommodate a wide range of designed roof slope angles and also is adapted to readily accommodate undesigned conditions encountered in actual construction where the angle of slope varies from the slope angle that is originally planned. The system provides for controlled collection and drainage of moisture and can be installed by a workman of only ordinary skill because acute angle cuts or compound angle cuts are not required.

Although the present invention has been described with reference to a single illustrated embodiment thereof, it should be understood that numerous other modifications and embodiments can be devised by those skilled in the art that will fall within the spirit and scope of the principles of this invention.

What is claimed as new and desired to be secured by Letters Patent of the United States is:

1. Adjustable angle eave apparatus comprising:

an elongated sill member forming a gutter for receiving moisture from a panelled wall structure extending angularly upwards of said member;

a wall structure including a frame having one or more rafters, and an elongated baffle member secured to the lower end of said rafter(s) extending along said sill member, and one or more panels supported from said frame;

bearing means for pivotally interconnecting said members to permit angular adjustment of the slope of said wall structure; and an elongated sill cover for enclosing a space between an outer portion of said sill member and an upper portion of said baffle member above said sill member, said sill cover including an upper portion having an arcuately curved surface generated about an axis coextensive with a pivot axis of said bearing means and having an upper edge adapted to be sealed with said upper portion of said baffle member.

2. The apparatus of claim 1 wherein said baffle member includes a flange extending outwardly of said rafters adapted to support a sealed joint with said upper edge portion of said sill cover.

3. The apparatus of claim 2 wherein said baffle member includes an upper surface and a flange spaced below said upper surface extending outwardly of said rafters to form a recessed shoulder for receiving an upper edge of said curved upper portion of said sill cover.

4. The apparatus of claim 3 wherein said baffle member includes an upper surface aligned with an outer surface of said arcuately curved surface of said sill cover.

5. The apparatus of claim 1 wherein said arcuately curved surface of said sill cover is adapted to be trimmed along an upper edge portion to accommodate different angles of slope of said panelled wall structure.

6. The apparatus of claim 1 wherein said sill member includes an upstanding outer wall and said sill cover includes an upstanding lower portion having a lower edge interconnected with said upstanding outer wall of said sill member.

7. The apparatus of claim 6 wherein said lower portion of said sill cover includes a planar outer surface segment spaced outwardly of an outer surface of said upstanding outer wall of said sill member.

8. The apparatus of claim 7 wherein said sill cover includes a flange on an inside surface forming a recess for receiving an upper portion of said upstanding outer wall of said sill member in keyed interlocking relation therewith.

9. The apparatus of claim 8 wherein said flange on said sill cover includes an inwardly and downwardly sloping lower segment facilitating the installation of said sill cover on said sill member in keyed interlocking relation with said upstanding outer wall thereof.

10. The apparatus of claim 1 wherein said bearing means includes a first hinge bracket mounted on top of a bottom wall of said sill member, a second hinge bracket extending outwardly of said baffle member and a pivot axle for pivotally interconnecting said brackets about a pivot axis generally parallel of longitudinal axes of said members.

11. The apparatus of claim 10 wherein said pivot axis is spaced above said sill member and outwardly of said baffle member below an upper surface of said panelled wall structure.

12. Adjustable angle eave apparatus comprising:

an elongated sill member forming a gutter for receiving moisture from an inclined wall structure sloping upwardly thereof;

a wall structure comprising one or more upwardly sloping rafters and an elongated baffle member connected to the lower end of said rafters and parallel of said sill;

hinge means for pivotally interconnecting said wall structure and said sill member for permitting adjustment of the slope angle of said wall structure; and cover means for enclosing the space above a bottom wall of said sill member and an upper edge of said wall structure along said baffle member to accommodate different angles of slope.

13. The adjustable angle eave apparatus of claim 12 wherein said cover means includes an arcuately curved wall portion spaced outwardly above a pivot axis of said hinge means.

14. The adjustable angle eave apparatus of claim 13 including a strip of sealing means along an edge of said arcuately curved wall portion.

15. The adjustable angle eave apparatus of claim 12 wherein said cover means includes a first portion on said baffle member and a portion on said sill member.

16. The adjustable angle eave apparatus of claim 15 including sealing means between said first and second portions.

17. The adjustable angle eave apparatus of claim 16 wherein edges of said first and second portions are overlapped and said sealing means is adjacent thereto.

18. The adjustable angle eave apparatus of claim 12 wherein said baffle member includes an upstanding extending wall joined to a lower end of said rafters and including an outer face opposite said rafter ends, said hinge means including a first hinge bracket extending outwardly of said outer face, a second hinge bracket mounted on a bottom wall of said sill member and a pivot pin means interconnecting said hinge brackets.

19. The adjustable angle eave apparatus of claim 18 wherein said pivot pin means is removable from said hinge brackets.

20. The adjustable angle eave apparatus of claim 18 wherein said first hinge bracket is mounted on said wall of said baffle member opposite a lower end of a rafter.

21. The adjustable angle eave apparatus of claim 20 including means on an inside face of said wall of said baffle member for aligning said first hinge bracket with said lower end of said rafter.

* * * * *